US010939196B2

(12) United States Patent
Kim et al.

(10) Patent No.: US 10,939,196 B2
(45) Date of Patent: Mar. 2, 2021

(54) LOUDSPEAKER AND ELECTRONIC APPARATUS INCLUDING THE SAME

(71) Applicant: SAMSUNG ELECTRONICS CO., LTD., Suwon-si (KR)

(72) Inventors: Sungjoo Kim, Suwon-si (KR); Jongbae Kim, Suwon-si (KR); Sungha Son, Suwon-si (KR); Youngsang Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/705,330

(22) Filed: Dec. 6, 2019

(65) Prior Publication Data

US 2020/0196051 A1 Jun. 18, 2020

(30) Foreign Application Priority Data

Dec. 17, 2018 (KR) ..... 10-2018-0163078

(51) Int. Cl.
*H04R 1/32* (2006.01)
*H04R 5/02* (2006.01)
*H04R 1/28* (2006.01)

(52) U.S. Cl.
CPC ..... *H04R 1/323* (2013.01); *H04R 1/2896* (2013.01); *H04R 5/02* (2013.01); *H04R 2201/403* (2013.01); *H04R 2499/15* (2013.01)

(58) Field of Classification Search
CPC ..... H04R 1/26; H04R 1/323; H04R 1/2811; H04R 5/02; H04R 2201/403; H04R 2499/15

(Continued)

(56) References Cited

U.S. PATENT DOCUMENTS 4,127,751 A * 11/1978 Kinoshita ..... H04R 1/288 181/146
4,401,857 A 8/1983 Morikawa
(Continued)

FOREIGN PATENT DOCUMENTS

| | | |
|---|---|---|
| JP | 2016-516351 | 6/2016 |
| KR | 10-2013-0069362 | 6/2013 |
| KR | 10-2018-0026265 | 3/2018 |

OTHER PUBLICATIONS

PCT ISR dated Apr. 8, 2020 for PCT/KR2019/017437.
PCT Written Opinion dated Apr. 8, 2020 for PCT/KR2019/017437.

*Primary Examiner* — Melur Ramakrishnaiah
(74) *Attorney, Agent, or Firm* — Nixon & Vanderhye P.C.

(57) ABSTRACT

Disclosed is an electronic apparatus comprising: an audio processor configured to process a sound signal; and a loudspeaker configured to output sound based on the sound signal, the loudspeaker comprising: a first driver; a second driver configured to output a frequency band higher than a frequency band output by the first driver; and a plate-shaped enclosure comprising a chamber accommodating the first driver and the second driver and a sound emission passage adjacent to the chamber, and the sound emission passage comprising: a first sound emission passage extending along an arrangement direction of the first driver and the second driver and having the first driver disposed therein; and a second sound emission passage extending along the arrangement direction of the first driver and the second driver inside the first sound emission passage and having the second driver disposed therein.

20 Claims, 19 Drawing Sheets

(58) Field of Classification Search
USPC ..... 381/306, 182, 186, 333, 338, 388
See application file for complete search history.

(56) References Cited

U.S. PATENT DOCUMENTS

| | | | | |
|---|---|---|---|---|
| 9,107,003 | B2 | 8/2015 | Dix et al. | |
| 2004/0245043 | A1 | 12/2004 | Noselli et al. | |
| 2005/0233781 | A1* | 10/2005 | Erixon | H04R 1/025 455/575.1 |
| 2011/0164767 | A1* | 7/2011 | Goel | H04M 1/03 381/182 |
| 2013/0156245 | A1 | 6/2013 | Dix et al. | |
| 2014/0029779 | A1 | 1/2014 | Yamauchi et al. | |
| 2017/0111739 | A1* | 4/2017 | Lan | G06F 3/165 |
| 2018/0167722 | A1 | 6/2018 | Christner et al. | |
| 2018/0332403 | A1 | 11/2018 | Rusconi Clerici Beltrami et al. | |

* cited by examiner

LOUDSPEAKER AND ELECTRONIC APPARATUS INCLUDING THE SAME

CROSS-REFERENCE TO RELATED APPLICATION

This application is based on and claims priority under 35 U.S.C. § 119 to Korean Patent Application No. 10-2018-0163078, filed on Dec. 17, 2018, in the Korean Intellectual Property Office, the disclosure of which is incorporated by reference herein in its entirety.

BACKGROUND

Field

The disclosure relates to a multiway loudspeaker and an electronic apparatus including the same.

Description of Related Art

Lately, a major change in a loudspeaker design has been made by slim or bezel-less designs of electronic apparatuses (e.g., a television (TV), a smartphone, etc.) including a loudspeaker, a design of audio equipment fit for a space, and a change in listening style such as casual listening and an ambient mode. The most remarkable change is that a slot-type loudspeaker includes a slot formed as a sound emission passage in front of a driver unit, the loudspeaker is disposed behind a panel of an electronic apparatus, for example, a TV, due to the slim design of the TV, and sound is emitted downward from the TV.

To ensure high fidelity (Hi-Fi) sound quality, a multiway speaker employing a plurality of driver units having different frequency reproduction bands is used. However, to configure multiway driver units in a slim or bezel-less design, there is no choice but to arrange driver units in a horizontal direction. Accordingly, it is difficult to obtain ideal directivity of the loudspeakers in the horizontal direction, and thus a problem arises in terms of a sweet spot.

As a virtual coaxial configuration which have coaxial effects in a specific direction like an actual coaxial configuration, there is a midwoofer-tweeter-midwoofer (MTM) configuration in which a tweeter is very closely arranged between two midwoofers to align a time axis of sound waves with a direction perpendicular to an arrangement direction so that sound image localization and sharpness of the high-frequency band can be improved. In practice, this configuration may have a problem of directivity in a mid-frequency band and requires a large space for a large number of driver units. Therefore, it is not possible to apply this configuration to slim or bezel-less designs.

As a loudspeaker appropriate for a slim or bezel-less design of a TV or a smartphone, there is a slot loudspeaker in which paths of sound waves generated by a plurality of driver units are unified and configured as a single outlet. Such a slot loudspeaker is for a slim or bezel-less design of a TV or a smartphone and has not been implemented using multiway driver units in a coaxial arrangement for a sweet spot. Further, even when multiway driver units in a coaxial arrangement for a sweet spot are disposed in an existing slot loudspeaker, high-frequency sound is emitted through a single large outlet, and thus the directivity is degraded.

SUMMARY

Embodiments of the disclosure provide a slot-type coaxial loudspeaker capable of improving horizontal directivity of high-frequency sound and an electronic apparatus including the slot-type coaxial loudspeaker.

According to an example embodiment, an electronic apparatus is provided, the electronic apparatus comprising: an audio processor configured to process a sound signal; and a loudspeaker configured to output sound based on the sound signal, the loudspeaker comprising: a first driver; a second driver configured to output a frequency band higher than a frequency band output by the first driver; and a plate-shaped enclosure comprising a chamber accommodating the first driver and the second driver and a sound emission passage adjacent to the chamber, the sound emission passage comprising: a first sound emission passage extending along an arrangement direction of the first driver and the second driver with the first driver disposed therein; and a second sound emission passage extending along the arrangement direction of the first driver and the second driver inside the first sound emission passage with the second driver disposed therein.

The second sound emission passage may be coaxial with the first sound emission passage along an extension direction of the first sound emission passage.

The second sound emission passage may extend over the second driver unit and may cover the second driver unit.

The loudspeaker may comprise: a third driver accommodated in the chamber and configured to output a sound having a frequency than a frequency of sound output by the second driver to the sound emission passage; and a third sound emission passage provided inside the second sound emission passage and extending along an extension direction of the second sound emission passage with the third driver unit disposed therein.

The chamber may comprise a first chamber and a second chamber provided with the sound emission passage interposed therebetween, the first driver is accommodated in the first chamber and is configured to output sound to the first sound emission passage, and the second driver is accommodated in the second chamber and is configured to output sound to the second sound emission passage.

The second sound emission passage may have a width identical to a diameter of the second driver.

The width of the second sound emission passage may be ¼ or less of a maximum output frequency wavelength of the first driver.

The first sound emission passage may comprise a backward passage extending over the first driver.

The backward passage may comprise at least one sound absorber.

The absorber may be configured to seal up the backward passage.

The backward passage may be bent.

The electronic apparatus may further comprise a display.

According to an example embodiment, an electronic apparatus is provided, the electronic apparatus comprising: an audio processor configured to process a sound signal; and a loudspeaker configured to output sound based on the sound signal, the loudspeaker comprising: a first driver; a second driver configured to output a frequency band higher than a frequency band of the first driver; and a plate-shaped enclosure comprising a first chamber accommodating the first driver, a second chamber accommodating the second driver, a first sound emission passage configured to emit sound output by the first driver, and a second sound emission passage disposed adjacent to the first sound emission passage and configured to emit sound output by the second driver, wherein the first sound emission passage extends with the first driver disposed between the first chamber and the second sound emission passage, and the second sound emission passage extends with the second driver disposed between the first sound emission passage and the second chamber.

A minor axis length of the first sound emission passage and the second sound emission passage may be ½ a maximum output frequency wavelength of the second driver.

According to an example embodiment, a loudspeaker for outputting sound is provided, the loudspeaker comprising: a first driver; a second driver configured to output a frequency band higher than a frequency band output by the first driver; and a plate-shaped enclosure comprising a chamber accommodating the first driver and the second driver and a sound emission passage adjacent to the chamber, the sound emission passage comprising: a first sound emission passage extending along an arrangement direction of the first driver and the second driver with the first driver disposed therein; and a second sound emission passage extending along the arrangement direction of the first driver and the second driver inside the first sound emission passage with the second driver disposed therein.

BRIEF DESCRIPTION OF THE DRAWINGS

The above and/or the aspects, features and advantages of certain embodiments of the present disclosure will become more apparent from the following detailed description, taken in conjunction with the accompanying drawings, in which.

DETAILED DESCRIPTION

Figure 1:
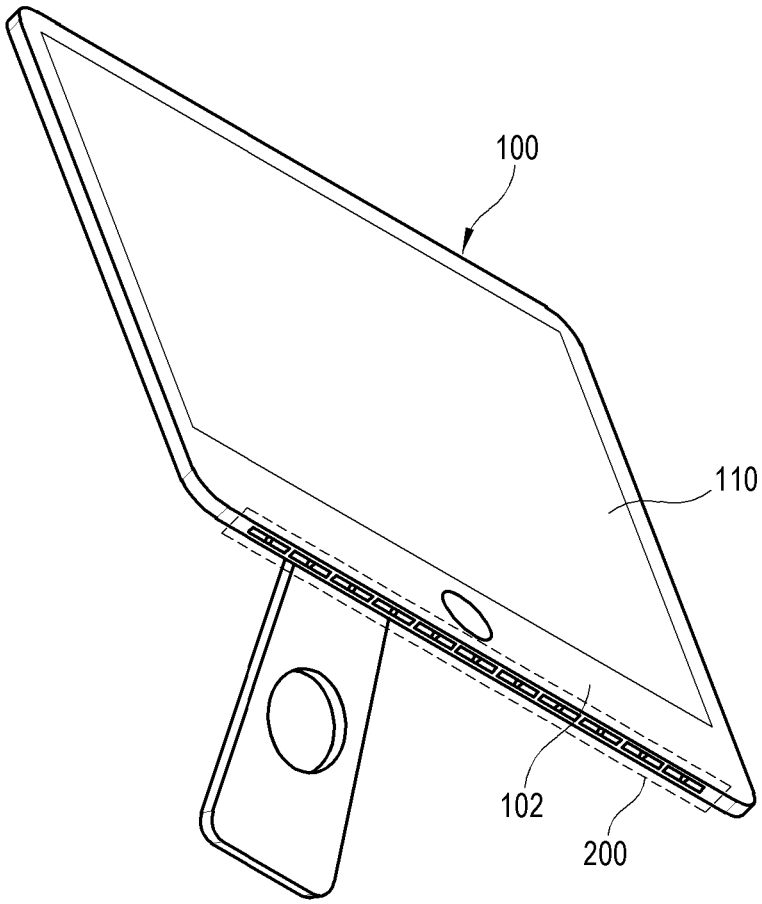
FIG. 1 is a perspective view illustrating an example electronic apparatus according to an embodiment of the disclosure.

Hereinafter, various example embodiments of the disclosure will be described in greater detail with reference to the accompanying drawings. Throughout the drawings, like reference numerals or signs may refer to or represent components performing substantially the same function. In the drawings, the size of each component may be exaggerated for clarity and convenience of description. However, the technical spirit, fundamental configuration, and effects of the disclosure are not limited to configurations or effects described in the following example embodiments. In describing the disclosure, detailed description of a well-known art or configuration related to the disclosure may be omitted when it is deemed to unnecessarily obscure the gist of the disclosure.

In example embodiments of the disclosure, the terms including ordinal numbers, such as "first" and "second," are used simply for distinguishing one element from other elements. Singular expressions, unless clearly defined otherwise in context, include plural expressions. It should be understood that the terms "comprise," "include," "have," etc. do not preclude the presence or addition of one or more other features, numbers, steps, operations, components, parts, or combinations thereof. In embodiments of the disclosure, the terms including "upper portion," "lower portion," "left side," "right side," "internal side," "external side," "internal surface," "external surface," "front," and "rear" may refer to relative orientations illustrated in the drawings, and the shape or location of each component is not limited by the terms. Also, in various example embodiments of the disclosure, at least one of a plurality of elements indicates all the elements, each of the elements, or all combinations of the elements.

FIG. 1 is a perspective view illustrating an example electronic apparatus 100 according to a first embodiment of the disclosure. The electronic apparatus 100 may include a display 110 surrounded by a bezel 102 and a loudspeaker 200 which emits sound. As shown in FIG. 1, the electronic apparatus 100 may be implemented as a display apparatus, such as, for example, and without limitation, a television (TV), a smart phone, a laptop computer, a tablet computer, or the like. However, the electronic apparatus 100 according to the first embodiment of the disclosure is not limited to a display apparatus and may be any apparatus which includes a loudspeaker and thus may output sound, such as an artificial intelligence (AI) loudspeaker.

Figure 2:
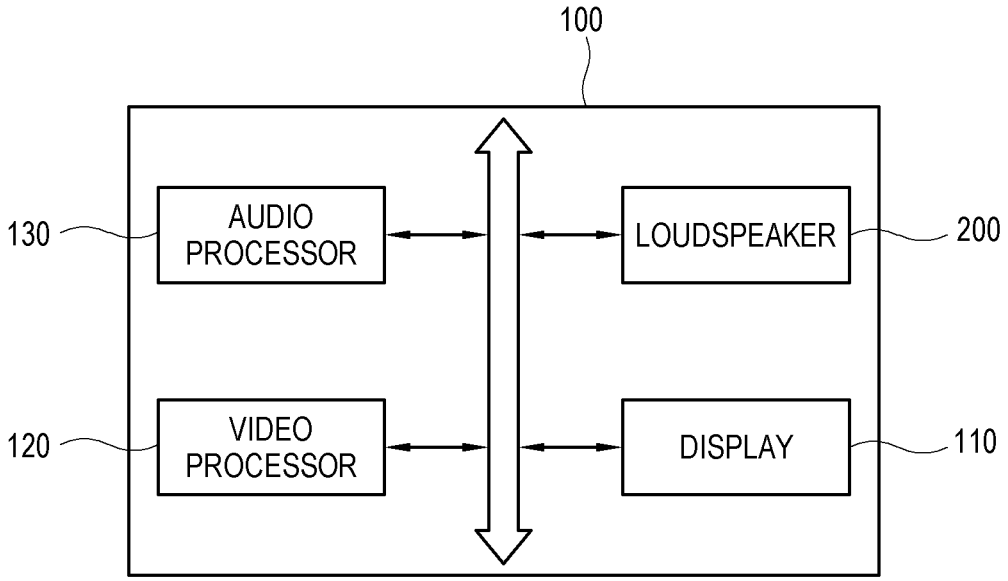
FIG. 2 is a block diagram illustrating an example configuration of the electronic apparatus of FIG. 1 according to an embodiment.

FIG. 2 is a block diagram illustrating an example configuration of the electronic apparatus 100 according to the first embodiment of the disclosure. The electronic apparatus 100 includes a display 110 for displaying an image, a video processor (e.g., including video processing circuitry) 120, an audio processor (e.g., including audio processing circuitry) 130, and the loudspeaker 200.

The display 110 displays an image based on a video signal processed by the video processor 120. The display 110 is not limited to a specific implementation method and may be implemented as various display panels, such as, for example, and without limitation, a liquid crystal display (LCD) panel, a plasma display panel, a light-emitting diode (LED) display panel, an organic light-emitting diode (OLED) display panel, a surface-conduction electron-emitter display panel, a carbon nanotube display panel, a nanocrystal display panel, or the like. According to the implementation method, the display 110 may additionally include an additional component. For example, when the display 110 is an LCD display, the display 110 may include a backlight unit (not shown) for providing light and a panel driver board (not shown) for driving a display panel (not shown).

The video processor 120 may include various video processing circuitry and performs various preset signal processing processes on a video signal received or stored in an external video supply source. The video processor 120 outputs the processed video signal to the display 110, thereby causing an image based on the video signal to be displayed on the display 110.

Signal processing performed by the video processor 120 is not limited to a specific type and may include, for example, demultiplexing for distributing a predetermined signal into characteristic-specific signals, decoding corresponding to the video format of a video signal, deinterlacing for converting an interlaced video signal into a progressive video signal, scaling for adjusting a video signal to a preset resolution, noise reduction for improving image quality, detail enhancement, and frame refresh rate conversion.

The video processor 120 may, for example, be implemented as a video processing board (not shown) that circuitry, such as various chipsets (not shown), memories (not shown), electronic parts (not shown), and wiring (not shown), for performing the processing is mounted on a printed circuit board (PCB) (not shown).

The audio processor 130 may include various audio processing circuitry and process an audio signal received or stored in an audio supply source. The processed audio signal is output as sound through the loudspeaker 200. The audio processor 130 may decompress, filter, and amplify the audio signal to be processed. The audio processor 130 may include a pre-filter for removing undesired sound through filtering, and an active filter for separating sound after amplification according to loudspeakers in charge of treble sound, mid-range sound, and bass sound.

The loudspeaker 200 may output sound according to the audio signal processed by the audio processor 130. The loudspeaker 200 according to the first embodiment of the disclosure will be described in detail below.

The loudspeaker 200 according to the first embodiment of the disclosure may, for example, be a so-called slot-type loudspeaker which is appropriate for a bezel-less or slim-type flat screen TV by way of example. The slot-type loudspeaker may refer, for example, to a loudspeaker in which an opening for outputting sound is designed to have a smaller cross-sectional area than the vibration plate of the loudspeaker, but the disclosure is not limited thereto. The loudspeaker 200 of FIG. 1 is provided in a lower portion of the electronic apparatus 100 so that sound may, for example, be output downward from the electronic apparatus 100. However, the position of the loudspeaker 200 in the electronic apparatus 100 and the sound output direction of the loudspeaker 200 are not limited to those shown in FIG. 1.

Figure 3:
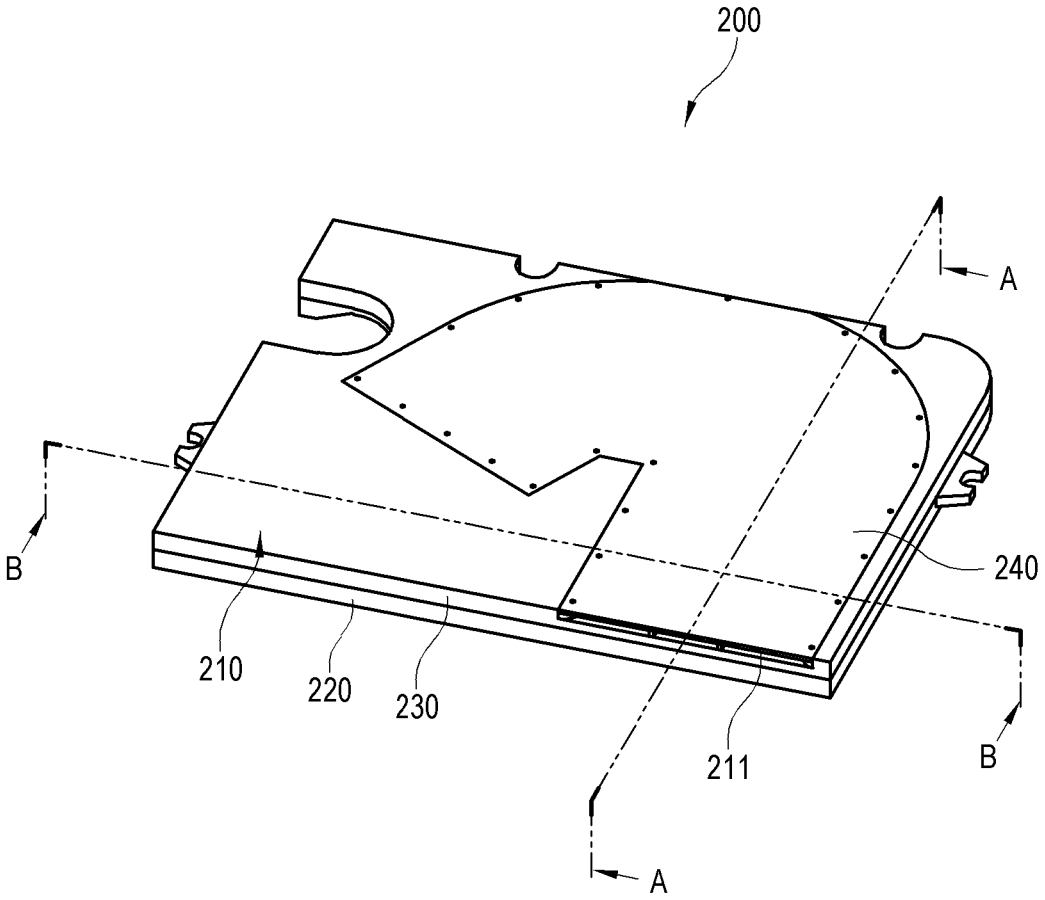
FIG. 3 is a perspective view illustrating an example loudspeaker according to an embodiment of the disclosure.

FIG. 3 is a perspective view illustrating an example slot-type coaxial loudspeaker 200 according to the first embodiment of the disclosure. The loudspeaker 200 according to the first embodiment of the disclosure includes a plate-shaped enclosure 210.

The plate-shaped enclosure 210 includes a unit accommodation portion 220, a passage forming portion 230, and a passage cover 240. The enclosure 210 has an outlet 211 for emitting sound in one side surface. The enclosure 210 is not limited to a specific shape or material.

Figure 4:
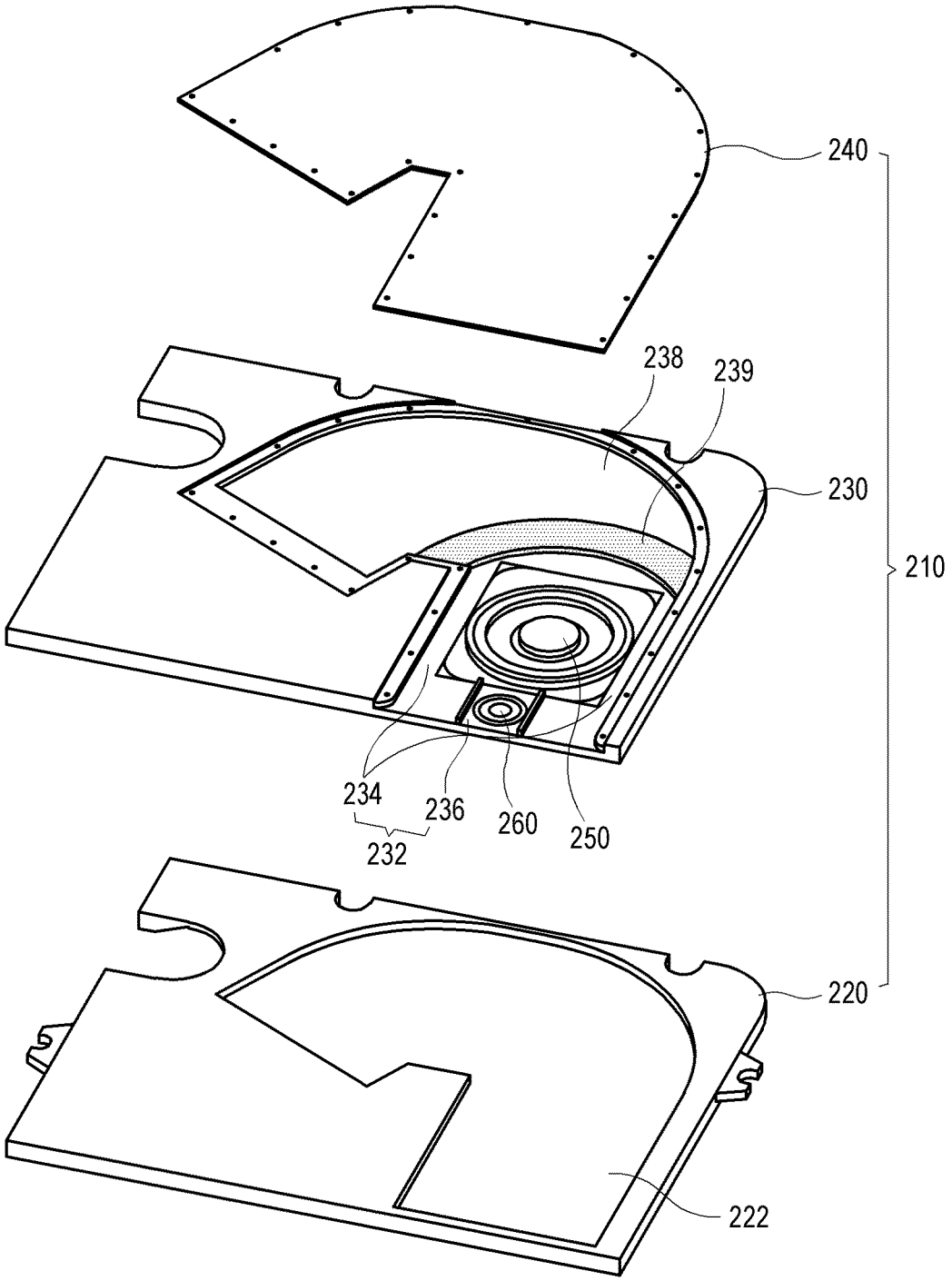
FIG. 4 is an exploded perspective view illustrating an example loudspeaker according to an embodiment of the disclosure.

FIG. 4 is an exploded perspective view of the example loudspeaker 200 according to the first embodiment of the disclosure. The loudspeaker 200 includes the plate-shaped enclosure 210 and first and second driver units 250 and 260 accommodated in the enclosure 210. The term "unit" as used herein with reference to various drivers may, for example, and without limitation, include various components of a speaker.

The enclosure 210 includes the unit accommodation portion 220, the passage forming portion 230, and the passage cover 240.

As shown in the drawing, the unit accommodation portion 220 is provided in a plate shape under the passage forming portion 230 and includes a unit chamber 222 having a space for accommodating the rear portions of the first and second driver units 250 and 260.

In the passage forming portion 230 in a plate shape, the first and second driver units 250 and 260 are provided, and the passage forming portion 230 includes a sound emission passage 232 which is sunken to a predetermined depth and extends with a predetermined width. On the bottom of the sound emission passage 232, the first and second driver units 250 and 260 are installed side by side in the extension direction. The sound emission passage 232 extends straight and bends to one side. The sound emission passage 232 is not limited to such a bent shape and may be designed in various shapes. In the bottom of the sound emission passage 232, the first and second driver units 250 and 260 whose rear portions are accommodated in the unit chamber 222 are installed so that the front surfaces of the first and second driver units 250 and 260 may be exposed.

The sound emission passage 232 includes a first sound emission passage 234 extending in the arrangement direction of the first driver unit 250 and the second driver unit 260 with the first driver unit 250 disposed therein and a second sound emission passage 236 extending in the extension direction of the first sound emission passage 234 in the first sound emission passage 234 with the second driver unit 260 disposed therein. The second sound emission passage 236 may, for example, be coaxial with the first sound emission passage 232. The first sound emission passage 234 may include a backward passage 238 which extends backward over the first driver unit 250 with a predetermined width and a predetermined depth. The backward passage 238 extends while bending to the left. The backward passage 238 includes a sound absorber 239 which absorbs sound emitted behind the first driver unit 250. The sound absorber 239 may be disposed to completely seal up the whole backward passage 238. The sound absorber 239 may prevent and/or reduce sound emitted behind the first driver unit 250 from being reflected and emitted to the front.

The passage cover 240 covers the sound emission passage 232 of the passage forming portion 230 in which the first driver unit 250 and the second driver unit 260 are installed.

The first driver unit 250 outputs sound of a predetermined frequency, for example, in 200 Hz to 1,000 Hz frequency bands based on an input sound signal. The first driver unit 250 may be provided in the enclosure 210 or along the enclosure 210.

The second driver unit 260 outputs sound of a predetermined frequency, for example, in 1,000 Hz to 20,000 Hz frequency bands based on an input sound signal. The second driver unit 260 may be coaxially arranged with the first driver unit 250 in the extension direction of the sound emission passage 232.

The configuration of the enclosure 200 is not limited to the unit accommodation portion 220, the passage forming portion 230, and the passage cover 240 shown in FIG. 4, and may have any form as long as it includes the unit chamber 222 and the sound emission passage 232.

Figure 5:
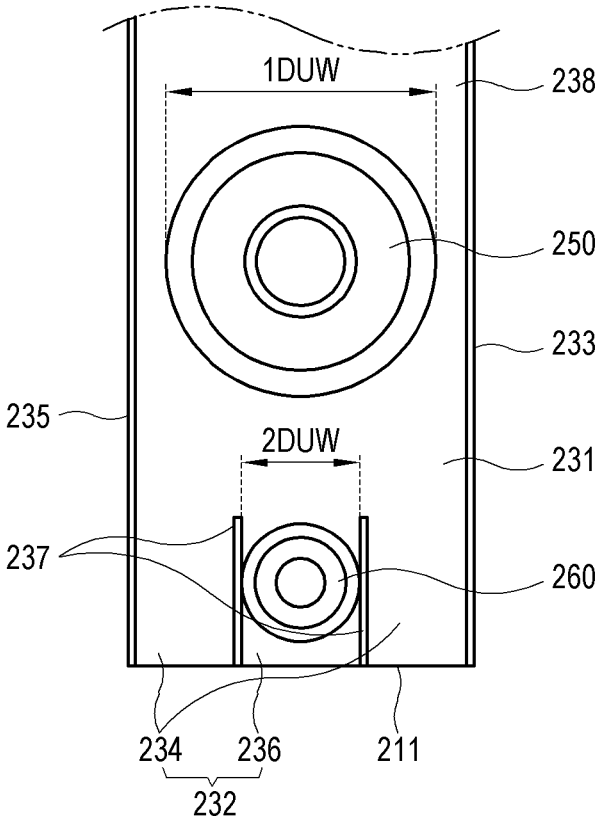
FIG. 5 is a diagram illustrating example driver units of FIG. 3 seen with a passage cover removed according to an embodiment of the disclosure.
Figure 6:
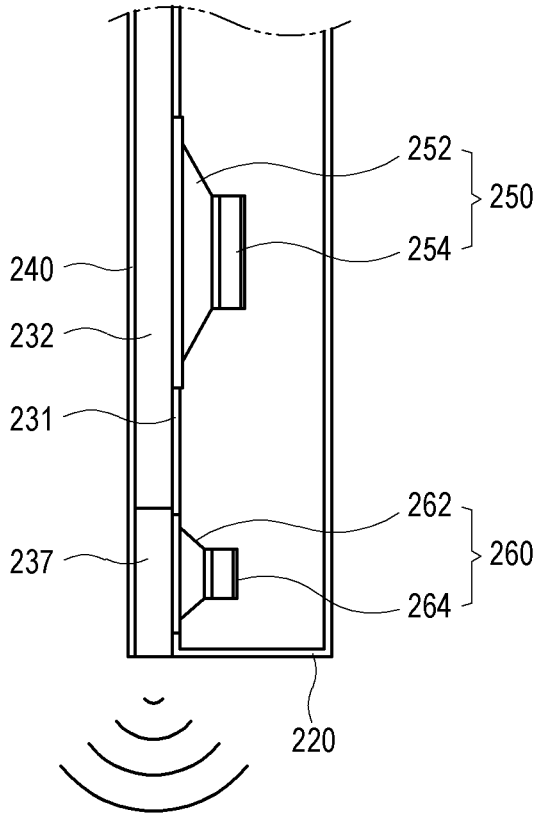
FIG. 6 is a cross-sectional view taken along line A-A of FIG. 3 according to an embodiment of the disclosure.
Figure 7:
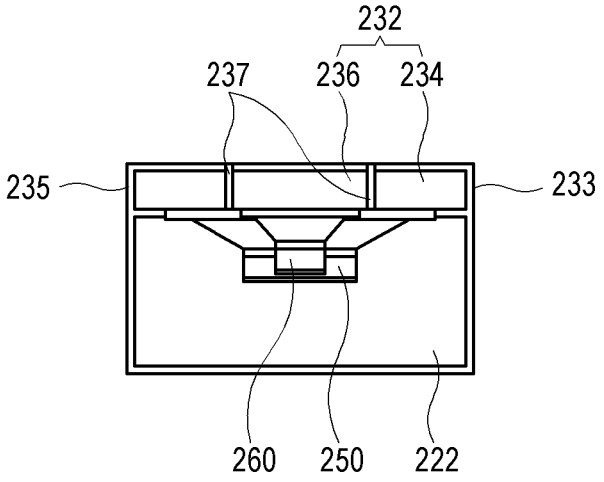
FIG. 7 is a cross-sectional view taken along line B-B of FIG. 3 according to an embodiment of the disclosure.

FIG. 5 is a top view illustrating the first and second driver units 250 and 260 with the passage cover 240 removed from the loudspeaker 200 according to the first embodiment of the disclosure, FIG. 6 is a cross-sectional view taken along line A-A of FIG. 3, and FIG. 7 is a cross-sectional view taken along line B-B of FIG. 3.

Referring to FIGS. 5, 6 and 7, the enclosure 210 includes the unit chamber 222 and the sound emission passage 232 positioned adjacent to each other.

The first and second driver units 250 and 260 are coaxially arranged with each other along the sound emission passage 232. The first and second driver units 250 and 260 are installed on a bottom 231 which is a partition between the unit chamber 222 and the sound emission passage 232. The first and second driver units 250 and 260 are disposed so that the rear portions are directed to the unit chamber 222 and the front portions are directed to the sound emission passage 232. Therefore, output sound is directed toward the sound emission passage 232. The output sound is emitted to the outside of the loudspeaker 200 through the outlet 211 in the side surface.

The first driver unit 250 reproduces sound in 200 Hz to 1,000 Hz frequency bands, for example, corresponding to a midwoofer. The first driver unit 250 includes a vibration plate 252 exposed to the sound emission passage 232 and a voice coil 254. The vibration plate 252 is formed of a thin and lightweight material in a trumpet shape and generates sound pressure by being vibrated according to vibrations of the voice coil 254 corresponding to a sound frequency. The voice coil 254 includes a permanent magnet (not shown) and a coil (not shown).

The second driver unit 260 reproduces sound in 1,000 Hz to 20,000 Hz frequency bands higher than that of the first driver unit 250, for example, corresponding to a tweeter. The second driver unit 260 includes a vibration plate 262 exposed to the sound emission passage 232 and a voice coil 264. The vibration plate 262 is formed of a thin and lightweight material in a trumpet shape and generates sound pressure by being vibrated according to vibrations of the voice coil 264 corresponding to a sound frequency. The voice coil 264 includes a permanent magnet (not shown) and a coil (not shown).

The sound emission passage 232 includes the first sound emission passage 234 and the second sound emission passage 236 extending with a width corresponding to a width 2DUW of the second driver unit 260.

The first sound emission passage 234 extends straight with a width corresponding to a width 1DUW of the first driver unit 250 from the side surface in which the outlet 211 is formed, further extends over the first driver unit 250, and bends to the left. The first sound emission passage 234 is formed by the bottom 231, two side walls 233 and 235, and the passage cover 240. The first sound emission passage 234 includes the backward passage 238 behind the first driver unit 250. The width of the first sound emission passage 234 may be slightly greater than the width 1DUW of the first driver unit 250. However, horizontal directivity of a maximum frequency band reproduced by the first driver unit 250 may be affected by the excessively large width of the first sound emission passage 234.

In the first sound emission passage 234, the second sound emission passage 236 extends straight with a width identical or close to the width 2DUW of the second driver unit 260 from the side surface in which the outlet 211 is formed and extends over the second driver unit 260. The second sound emission passage 236 extends coaxially with the first sound emission passage 234.

The second sound emission passage 236 is formed by the bottom 231, one pair of walls 237 built with the width 2DUW in the first sound emission passage 234, and the passage cover 240. The second sound emission passage 236 is open forward and backward. The one pair of walls 237 are provided at the outlet 211 to pass at least the second driver unit 260 with the height of the gap between the passage cover 240 and the bottom 231.

The pair of walls 237 are installed at an interval which is identical to the width 2DUW of the second driver unit 260 or as close to the width 2DUW as possible. Then, interference does not occur when low-frequency sound of the first driver unit 250 passes through the second sound emission passage 236, and it is possible to prevent reflection of some high-frequency components in the second sound emission passage 236.

When the second sound emission passage 236 is disposed from the outlet 211 only up to the front of the second driver unit 260, high-frequency band sound emitted by the second driver unit 260 leaks to the first sound emission passage 234 in a portion not covered by the second sound emission passage 236 so that directivity may be degraded. Therefore, the one pair of walls 237 are disposed to completely cover the second driver unit 260.

The width of the second sound emission passage 236 is designed to be ¼ or less of a maximum output frequency wavelength λ of the first driver unit 250 so that a frequency emitted from the first driver unit 250 may be emitted through the outlet 211 without interference. For example, when the reproduction frequency band of the first driver unit 250 is 200 Hz to 1,000 Hz, the maximum frequency wavelength λ is about 34 cm, and the width of the second sound emission passage 236 has to be about 8 cm or less.

When high-frequency sound emitted from the second driver unit 260 is directly emitted to the first sound emission passage 234 having a wide width without the second sound emission passage 236, the high-frequency sound loses directivity at the initial stage of emission, and thus it is not possible to obtain sufficient horizontal directivity. The second sound emission passage 236 having a narrow width corresponding to the width of the second driver unit 260 is formed in the first sound emission passage 234 coaxially with the first sound emission passage 234 to emit only high-frequency sound emitted from the second driver unit 260. In this way, it is possible to improve horizontal directivity of the loudspeaker 200 according to the first embodiment of the disclosure.

Figure 8:
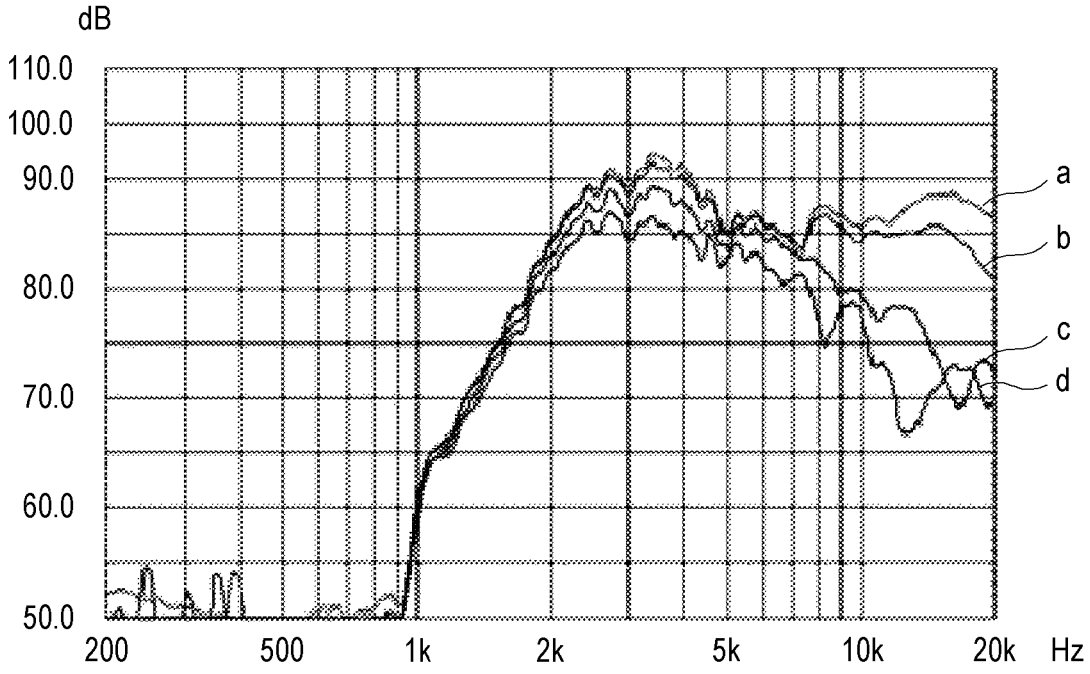
FIG. 8 is a graph illustrating example high-frequency directivity of a second driver unit in the loudspeaker according to an embodiment of the disclosure.

FIG. 8 is a graph showing the directivity of the second driver unit 260 in the loudspeaker 200 according to the first embodiment of the disclosure. Four graphs a, b, c, and d show the directivity of sound in 1,000 Hz to 20,000 Hz frequency bands respectively measured at 0, 15, 30, and 45 degree positions with respect to the center axis of the front surface of the loudspeaker 200. As shown in the drawing, at the center position (0 degrees), high-frequency sound (graph a) gradually increases from 65 dB to 85 dB at 1 kHz to 2 kHz and becomes about 85 dB to about 90 dB at 2 kHz to 20 kHz. At the 15-degree position, the high-frequency sound (graph b) gradually increases from 65 dB to 85 dB at 1 kHz to 2 kHz and becomes about 80 dB to about 90 dB at 2 kHz to 20 kHz. At the 30-degree position, high-frequency sound (graph c) gradually increases from 65 dB to 85 dB at 1 kHz to 2 kHz and becomes about 74 dB to about 90 dB at 2 kHz to 20 kHz. At the 45-degree position, high-frequency sound (graph d) gradually increases from 65 dB to 85 dB at 1 kHz to 2 kHz and becomes about 70 dB to about 90 dB at 2 kHz to 20 kHz. As described above, the loudspeaker 200 according to the first embodiment of the disclosure forms a sweet spot for sound in 1,000 Hz to 20,000 Hz frequency bands at 0 degrees to 45 degrees left and right with respect to the center axis of the front surface thereof.

Figures 9A, 9B:
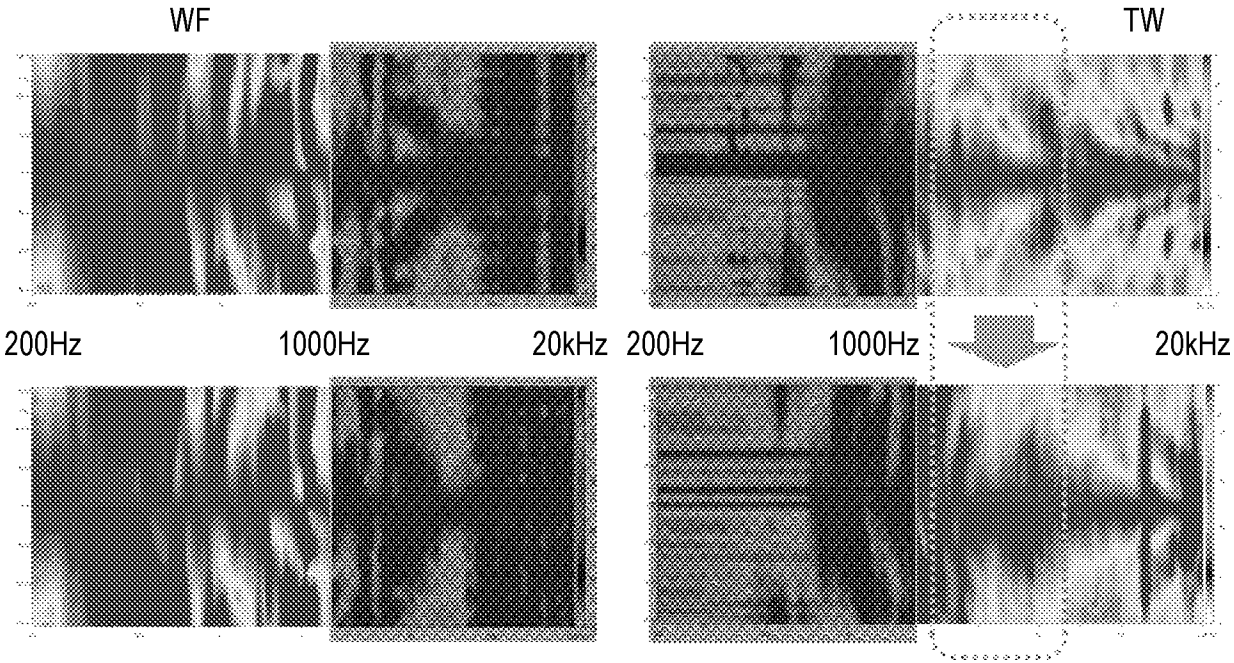
FIGS. 9A and 9B are sets of pictures in which high-frequency directivity measured for comparison according to whether there is a second sound emission passage in the loudspeaker according to an embodiment of the disclosure.

FIGS. 9A and 9B are sets of pictures in which the directivity of the loudspeaker 200 is measured for comparison between a case illustrated in FIG. 9A where there is the second sound emission passage 236 in the first embodiment shown in FIGS. 5, 6 and 7 and a case illustrated in FIG. 9B where there is no second sound emission passage. As shown in the drawing, there is no significant difference in the midwoofer frequency band of 200 Hz to 1,000 Hz, but the directivity in 1,000 Hz to 20,000 Hz frequency bands remarkably increases in the case illustrated in FIG. 9B. Therefore, a listener may uniformly hear high-frequency sound components together with low-frequency sound components within a horizontally wide range from the center axis of the loudspeaker 200.

As described above, sound reproduced by the first driver unit 250 has a wavelength longer than the width of the second sound emission passage 236, and thus does not affect the directivity. Among sound waves reproduced by the second driver unit 260, sound waves having a wavelength shorter than the width of the second sound emission passage 236 affects directivity. As a result, directivity in a high-frequency band corresponding to the second sound emission passage 236 is varied depending on the width of the second sound emission passage 236.

Figure 10:
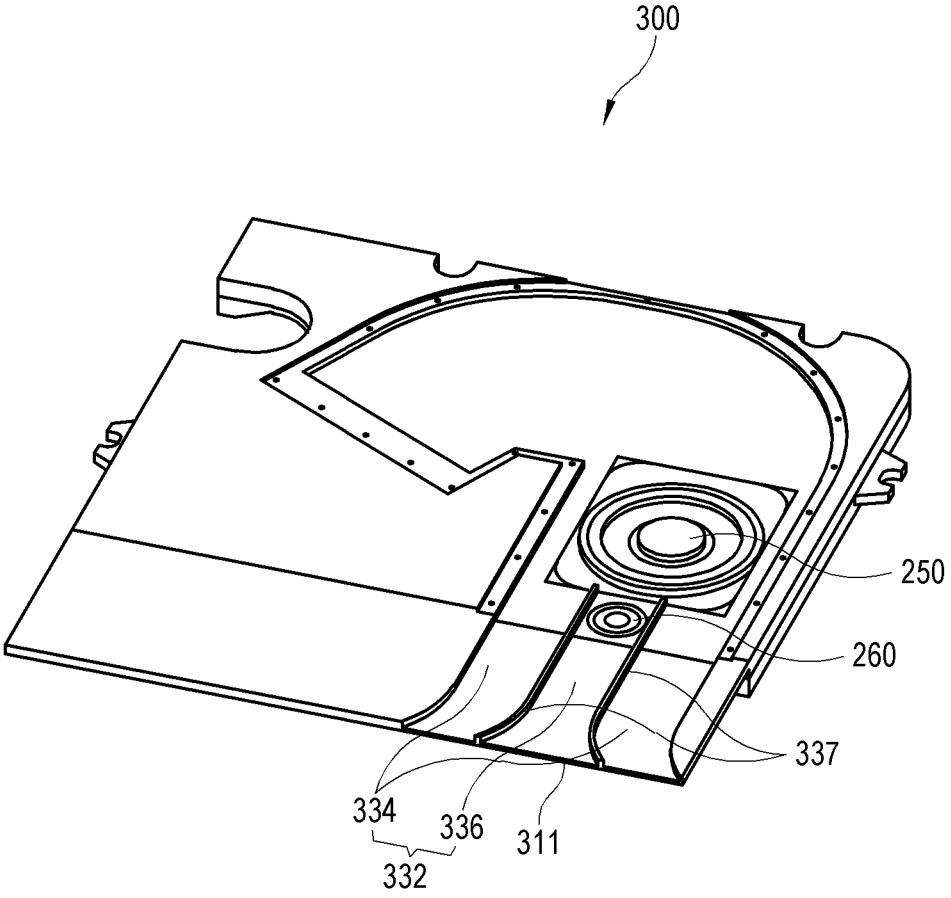
FIG. 10 is a perspective view illustrating an example loudspeaker according to an embodiment of the disclosure.

FIG. 10 is a perspective view illustrating an example structure of a loudspeaker 300 according to a second embodiment of the disclosure. As shown in the drawing, in the speaker 300 according to the second embodiment, a section extending straight from an outlet 311 of a sound emission passage 332 is longer than that in the loudspeaker 200 of the first embodiment shown in FIG. 5, and first and second driver units 250 and 260 are formed inside. As a result, the length of one pair of walls 337 built in a first sound emission passage 334 to form a second sound emission passage 336 increases. The first sound emission passage 334 and the second sound emission passage 336 are slightly enlarged on the side of the outlet 311. As described above, even when the length of the second sound emission passage 336 from the second driver unit 260 to the outlet 311 increases, the directivity of high frequencies is not degraded compared to that of the loudspeaker 200 of the first embodiment.

Figure 11:
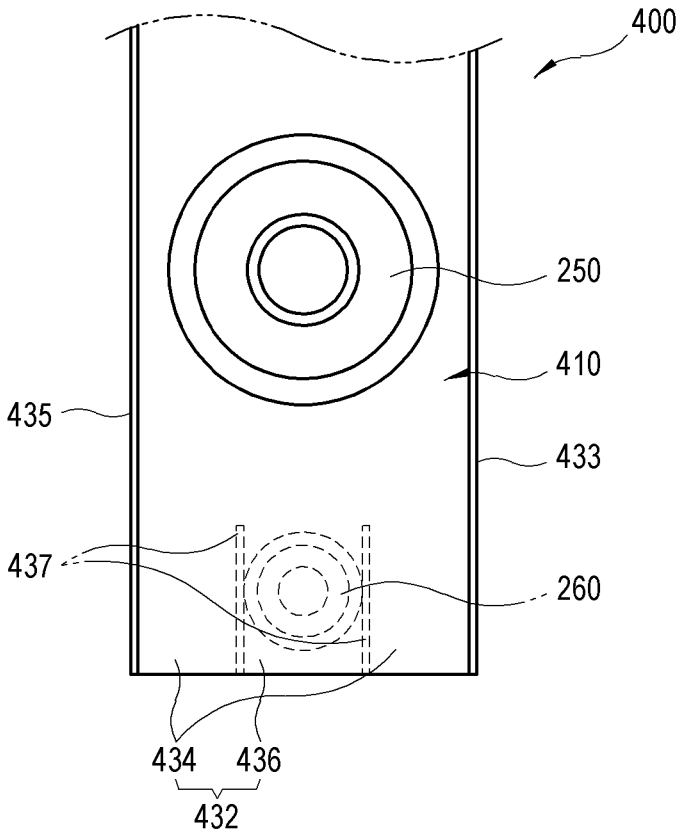
FIG. 11 is a diagram illustrating an example loudspeaker according to an embodiment of the disclosure.

FIG. 11 is a diagram illustrating an example structure of a loudspeaker 400 according to a third embodiment of the disclosure.

As shown in the drawing, the loudspeaker 400 according to the third embodiment includes a first driver unit 250, a second driver unit 260, and an enclosure 410. Unlike the loudspeaker 200 according to the first embodiment, in the loudspeaker 400 according to the third embodiment, the first driver unit 250 and the second driver unit 260 are disposed to face each other with a sound emission passage 432 interposed therebetween.

The first driver unit 250 and the second driver unit 260 are the same as those in the first embodiment, and description thereof may not be repeated here.

Figure 12:
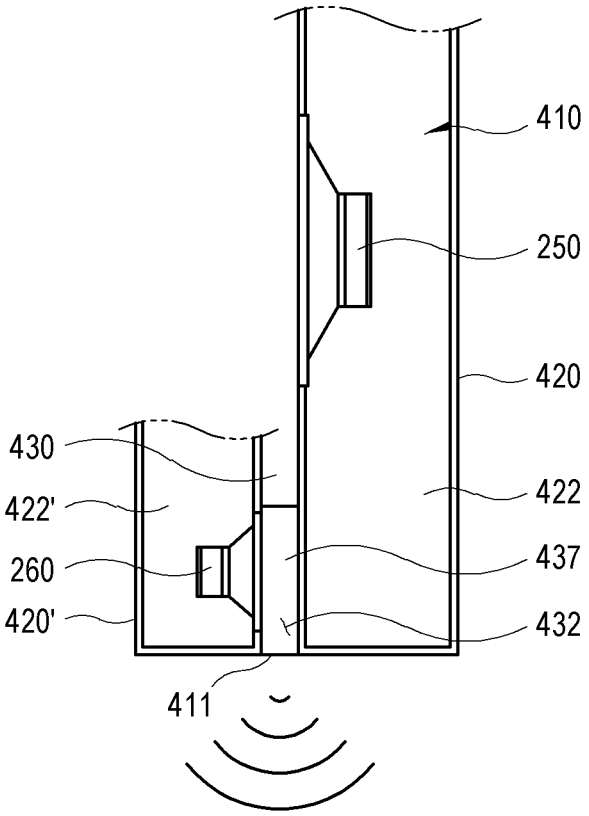
FIG. 12 is a diagram illustrating an example loudspeaker according to an embodiment of the disclosure.

FIG. 12 is a diagram illustrating an example structure of a loudspeaker 400 according to a third embodiment of the disclosure.

The enclosure 410 of FIG. 11 includes a first unit accommodation portion 420 for accommodating the first driver unit 250, a second unit accommodation portion 420' for accommodating the second driver unit 260, and a passage forming portion 430 interposed between the first unit accommodation portion 420 and the second unit accommodation portion 420'.

The first unit accommodation portion 420 includes a first unit chamber 422 therein. The first driver unit 250 is installed so that the rear portion is positioned in the first unit chamber 422 and the front portion is exposed to the sound emission passage 432. As a result, sound emitted from the first driver unit 250 is transmitted to the sound emission passage 432.

The second unit accommodation portion 420' includes a second unit chamber 422' therein. The second driver unit 260 is installed so that the rear portion is positioned in the second unit chamber 422' and the front portion is exposed to the sound emission passage 432. As a result, sound emitted from the second driver unit 260 is transmitted to the sound emission passage 432.

The passage forming portion 430 forms the sound emission passage 432 which receives sound emitted from the first driver unit 250 and the second driver unit 260 and emits the received sound to an outlet 411 in a side surface.

Figure 13:
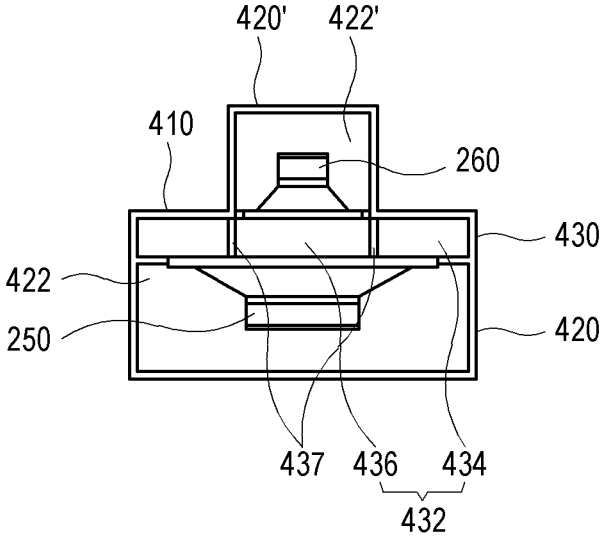
FIG. 13 is a diagram showing illustrating an example loudspeaker according to an embodiment of the disclosure.

FIG. 13 is a diagram illustrating an example structure of a loudspeaker 400 according to a third embodiment of the disclosure.

As shown in FIG. 13, the sound emission passage 432 includes a first sound emission passage 434 having a width approximately corresponding to the width of the first driver unit 250 and a second sound emission passage 436 having a width approximately corresponding to the width of the second driver unit 260. The first sound emission passage 434 and the second sound emission passage 436 are arranged coaxially with each other.

Figure 14:
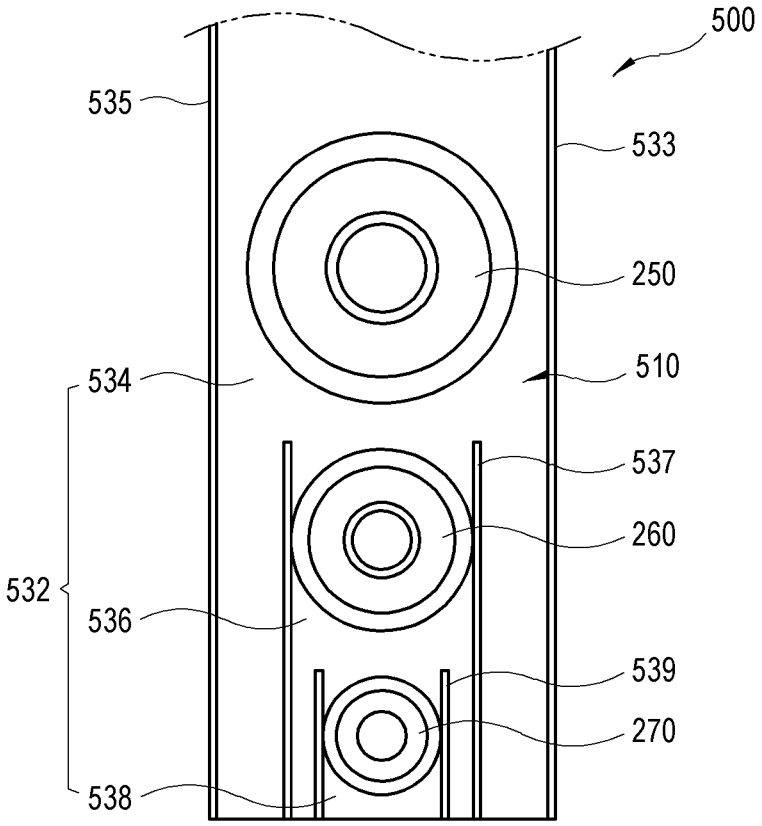
FIG. 14 is a diagram illustrating an example loudspeaker according to an embodiment of the disclosure.

FIG. 14 is a diagram illustrating an example structure of a loudspeaker 500 according to a fourth embodiment of the disclosure.

As shown in the drawing, the loudspeaker 500 according to the fourth embodiment includes a first driver unit 250, a second driver unit 260, a third driver unit 270, and an enclosure 510. The loudspeaker 500 according to the fourth embodiment is configured with 3-way driver units unlike 2-way driver units of the first embodiment.

The first driver unit 250, the second driver unit 260, and the third driver unit 270 are basically the same as those of the first embodiment, and description thereof will not be repeated here. However, sounds reproduced by the first driver unit 250, the second driver unit 260, and the third driver unit 270 are set different in frequency bands.

As shown in FIG. 14, the sound emission passage 532 includes a first sound emission passage 534 having a width approximately corresponding to the width of the first driver unit 250, a second sound emission passage 536 having a width approximately corresponding to the width of the second driver unit 260, and a third sound emission passage 538 having a width approximately corresponding to the width of the third driver unit 270. The first to third sound emission passages 534, 536, and 538 are arranged coaxially with each other.

The width of the second sound emission passage 536 is designed to be ¼ or less of the maximum output frequency wavelength reproduced by the first driver unit 250 so that reproduction sound of the first driver unit 250 may not be interfered by the second sound emission passage 536.

Likewise, the width of the third sound emission passage 538 is designed to be ¼ or less of the maximum output frequency wavelength reproduced by the second driver unit 260 so that reproduction sound of the second driver unit 260 may not be interfered by the third sound emission passage 538.

Figure 15:
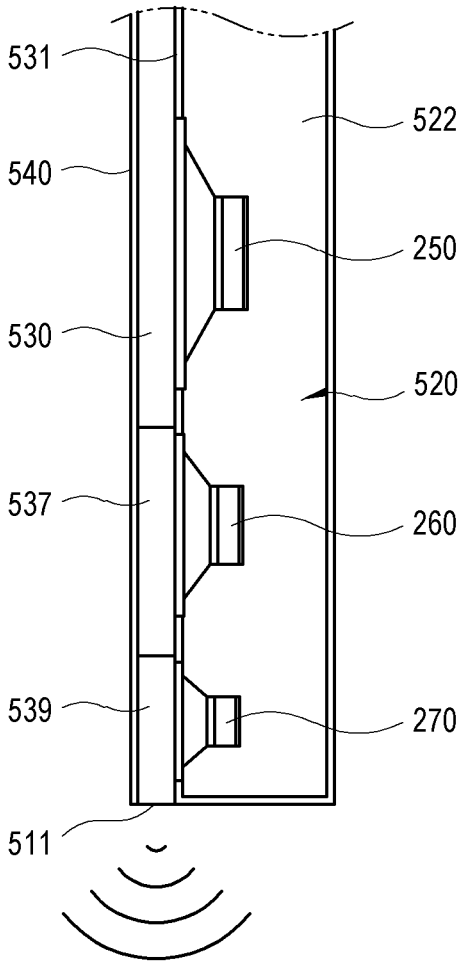
FIG. 15 is a diagram illustrating an example loudspeaker according to an embodiment of the disclosure.
Figure 16:
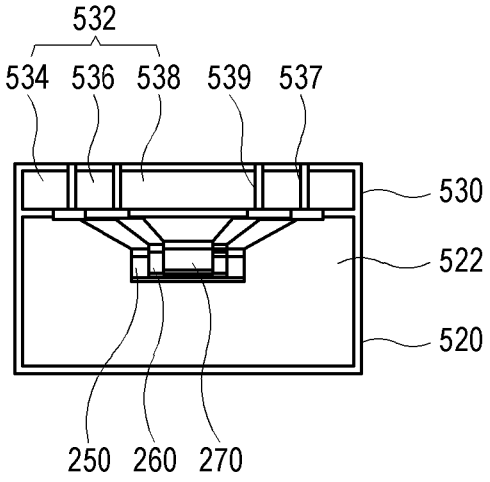
FIG. 16 is a diagram illustrating an example loudspeaker according to an embodiment of the disclosure.

FIG. 15 is a diagram illustrating an example structure of a loudspeaker 500 according to a fourth embodiment of the disclosure; and FIG. 16 is a diagram illustrating an example structure of a loudspeaker 500 according to a fourth embodiment of the disclosure.

The enclosure 510 of FIG. 14 includes a unit accommodation portion 520 for accommodating the first to third driver units 250, 260, and 270 and a passage forming portion 530 for receiving sound emitted from the first to third driver units 250, 260, and 270 and emitting the received sound to an outlet 511 in a side surface. The first to third driver units 250, 260, and 270 are arranged coaxially with each other along the extension direction of the sound emission passage 532.

The unit accommodation portion 520 includes a unit chamber 522 therein. The first to third driver units 250, 260, and 270 are installed having their rear portions positioned in the unit chamber 522 and their front portions exposed to the sound emission passage 532. As a result, sound emitted from the first to third driver units 250, 260, and 270 is transmitted to the sound emission passage 532.

The passage forming portion 530 forms the sound emission passage 532 which receives sound emitted from the first to third driver units 250, 260, and 270 and emits the received sound to the outlet 511 in the side surface.

Figure 17:
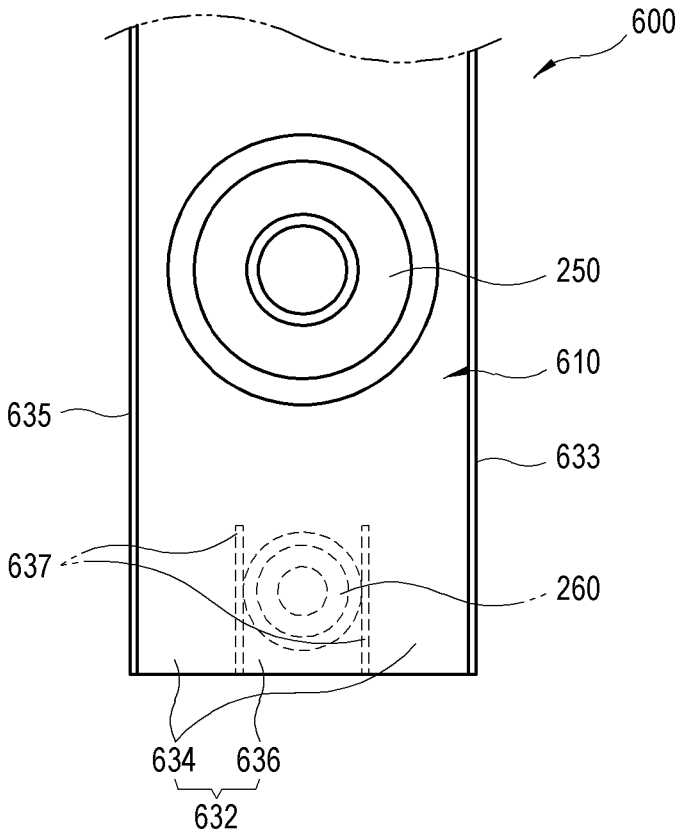
FIG. 17 is a diagram illustrating an example loudspeaker according to an embodiment of the disclosure.

FIG. 17 is a diagram illustrating an example loudspeaker according to a fifth embodiment of the disclosure.

As shown in the drawing, the loudspeaker 600 according to the fifth embodiment includes a first driver unit 250, a second driver unit 260, and an enclosure 610. Unlike the loudspeaker 200 according to the first embodiment, the loudspeaker 600 according to the fifth embodiment includes separate first and second sound emission passages 634 and 636 to which low-frequency sound and high-frequency sound are separately emitted from the first driver unit 250 and the second driver unit 260.

The first driver unit 250 and the second driver unit 260 are the same as the first embodiment, and description thereof is omitted.

Figure 18:
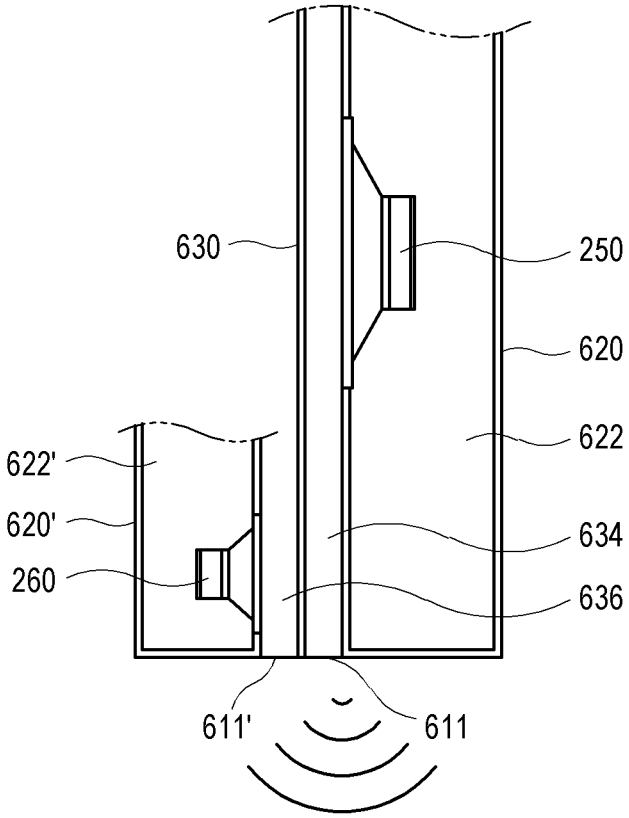
FIG. 18 is a diagram illustrating an example loudspeaker according to an embodiment of the disclosure.

FIG. 18 is a diagram illustrating an example loudspeaker according to a fifth embodiment of the disclosure.

The enclosure 610 of FIG. 17 includes the first unit accommodation portion 620 for accommodating the first driver unit 250, the second unit accommodation portion 620' for accommodating the second driver unit 260, and a passage forming portion 630 interposed between the first unit accommodation portion 620 and the second unit accommodation portion 620'.

The first unit accommodation portion 620 includes a first unit chamber 622 therein. The first driver unit 250 is installed so that its rear portion is positioned in the first unit chamber 622 and its front portion is exposed to the first sound emission passage 634. As a result, sound emitted from the first driver unit 250 is transmitted to the first sound emission passage 634.

The second unit accommodation portion 620' includes a second unit chamber 622' therein. The second driver unit 260 is installed so that its rear portion is positioned in the second unit chamber 622' and its front portion is exposed to the second sound emission passage 636. As a result, sound emitted from the second driver unit 260 is transmitted to the second sound emission passage 636.

The passage forming portion 630 forms the first and second sound emission passages 634 and 636 which receive low-frequency sound and high-frequency sound respectively emitted from the first and second driver units 250 and 260 and emit the received sound to first and second outlets 611 and 611' in a side surface.

Figure 19:
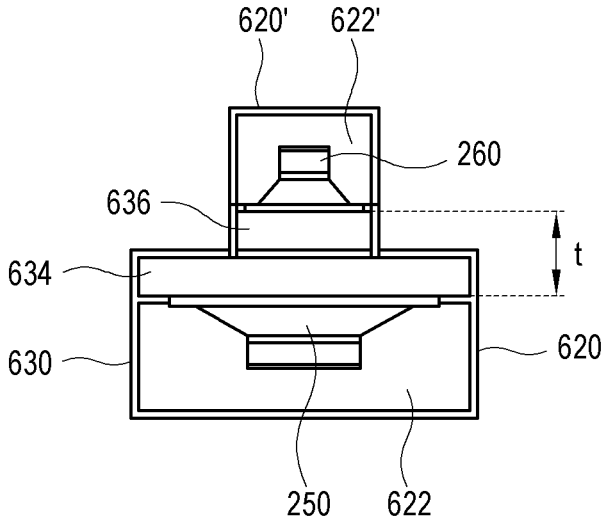
FIG. 19 is a diagram illustrating an example loudspeaker according to an embodiment of the disclosure.

FIG. 19 is a diagram illustrating an example loudspeaker according to a fifth embodiment of the disclosure.

As shown in FIG. 19, the first and second sound emission passages 634 and 636 includes the first sound emission passage 634 having a width approximately corresponding to the width of the first driver unit 250 and the second sound emission passage 636 having a width approximately corresponding to the width of the second driver unit 260. The first and second sound emission passages 634 and 636 are separated but adjacent to each other in the thickness direction and arranged coaxially with each other.

The minor axis length, that is, a close distance t, of the first and second outlets 611 and 611' of the first and second sound emission passages 634 and 636 is ½ or less of the maximum frequency reproduced by the second driver unit 260. For example, assuming that the maximum frequency reproduced by the second driver unit 260 is 20 kHz, the wavelength is 3.4 cm, and thus the close distance t of the first and second outlets 611 and 611' is 17 mm or less.

As described above, according to the disclosure, it is possible to provide a slot-type coaxial loudspeaker capable of providing a sweet spot by improving the horizontal directivity of high-frequency sound and an electronic apparatus including the slot-type coaxial loudspeaker.

A slot-type coaxial loudspeaker applied to an electronic apparatus may improve sound quality by increasing horizontal directivity of high-frequency sound.

It is possible to improve sound quality by increasing horizontal directivity of high-frequency sound.

It is possible to prevent and/or reduce leakage of high-frequency sound with a second sound emission passage.

It is possible to provide improved sound quality.

It is possible to prevent and/or reduce unnecessary reflection of high-frequency sound.

It is possible to prevent and/or reduce sound emitted from a first driver unit from being interfered by the second sound emission passage.

It is possible to prevent and/or reduce sound quality from being degraded by unnecessary sound reflection.

It is possible to absorb sound emitted backward.

It is possible to improve sound quality by setting the minor-axis lengths of the first sound emission passage and the second sound emission passage to half the maximum output frequency wavelength of a second driver unit.

While a various example embodiments have been illustrate and described with reference to the various drawings, it will be appreciated by those skilled in the art that various changes in form and details may be made without departing from the principles and spirit of the disclosure, which as set forth, for example, in the appended claims and their equivalents.

What is claimed is:

1. An electronic apparatus comprising:

an audio processor configured to process a sound signal; and a loudspeaker configured to output sound based on the sound signal, the loudspeaker comprising:

a first driver;

a second driver configured to output a frequency band higher than a frequency band output by the first driver; and a plate-shaped enclosure comprising a chamber accommodating the first driver and the second driver and a sound emission passage adjacent to the chamber, wherein the sound emission passage comprises:

a first sound emission passage extending along an arrangement direction of the first driver and the second driver and having the first driver disposed therein; and a second sound emission passage extending along the arrangement direction of the first driver and the second driver, disposed inside the first sound emission passage and having the second driver disposed therein.

2. The electronic apparatus of claim 1, wherein the second sound emission passage is arranged to be coaxial with the first sound emission passage along an extension direction of the first sound emission passage.

3. The electronic apparatus of claim 1, wherein the second sound emission passage is arranged to extend over the second driver and to cover the second driver.

4. The electronic apparatus of claim 1, wherein the loudspeaker comprises:

a third driver disposed in the chamber and configured to output frequency band higher than the frequency band output by the second driver to the sound emission passage; and a third sound emission passage provided inside the second sound emission passage and extending along an extension direction of the second sound emission passage with the third driver disposed therein.

5. The electronic apparatus of claim 1, wherein the chamber comprises a first chamber and a second chamber with the sound emission passage interposed between the first chamber and the second chamber, the first driver disposed in the first chamber and configured to output sound to the first sound emission passage, and the second driver disposed in the second chamber and configured to output sound to the second sound emission passage.

6. The electronic apparatus of claim 1, wherein the second sound emission passage has a width equal to a diameter of the second driver.

7. The electronic apparatus of claim 6, wherein the width of the second sound emission passage is ¼ or less of a maximum output frequency wavelength of the first driver.

8. The electronic apparatus of claim 1, wherein the first sound emission passage comprises a backward passage extending over the first driver.

9. The electronic apparatus of claim 8, wherein the backward passage comprises at least one sound absorber comprising a sound absorbing material.

10. The electronic apparatus of claim 9, wherein the absorber is configured to seal the backward passage.

11. The electronic apparatus of claim 8, wherein the backward passage is bent.

12. The electronic apparatus of claim 1, further comprising a display.

13. An electronic apparatus comprising:

an audio processor configured to process a sound signal; and a loudspeaker configured to output sound based on the sound signal, the loudspeaker comprising:

a first driver;

a second driver configured to output a frequency band higher than a frequency band output by the first driver; and a plate-shaped enclosure comprising a first chamber accommodating the first driver, a second chamber accommodating the second driver, a first sound emission passage configured to emit sound output by the first driver, and a second sound emission passage disposed adjacent to the first sound emission passage in a thickness direction of the first and second sound emission passages and configured to emit sound output by the second driver, wherein the first sound emission passage extends with the first driver disposed between the first chamber and the second sound emission passage, and the second sound emission passage extends with the second driver disposed between the first sound emission passage and the second chamber and includes a width that is smaller than a width of the first sound emission passage.

14. The electronic apparatus of claim 13, wherein a minor axis length of the first sound emission passage and the second sound emission passage is ½ of a maximum output frequency wavelength of the second driver.

15. The electronic apparatus of claim 13, wherein the width of the first sound emission passage approximately corresponds to a width of the first driver and the width of the second sound emission passage approximately corresponds to a width of the second driver.

16. The electronic apparatus of claim 13, wherein the width of the second sound emission passage is ¼ or less of a maximum output frequency wavelength of the first driver.

17. A loudspeaker configured to output sound, the loudspeaker comprising:

a first driver;

a second driver configured to output a frequency band higher than a frequency band output by the first driver; and a plate-shaped enclosure comprising a chamber accommodating the first driver and the second driver and a sound emission passage adjacent to the chamber, wherein the sound emission passage comprises:

a first sound emission passage extending along an arrangement direction of the first driver and the second driver and having the first driver disposed therein; and a second sound emission passage extending along the arrangement direction of the first driver and the second driver, disposed inside the first sound emission passage and having the second driver disposed therein.

18. The loudspeaker of claim 17 comprising:

a third driver disposed in the chamber and configured to output frequency band higher than the frequency band output by the second driver to the sound emission passage; and a third sound emission passage provided inside the second sound emission passage and extending along an extension direction of the second sound emission passage with the third driver disposed therein.

19. The loudspeaker of claim 17, wherein a width of the second sound emission passage is ¼ or less of a maximum output frequency wavelength of the first driver.

20. The loudspeaker of claim 17, wherein the first sound emission passage comprises a backward passage extending over the first driver and comprising at least one sound absorber including a sound absorbing material.

* * * * *